United States Patent [19]

Wayne

[11] 4,265,098

[45] May 5, 1981

[54] DEVICE FOR CARRYING A REMOVABLE PENDANT

[75] Inventor: Kurt Wayne, White Plains, N.Y.

[73] Assignee: Kurt Wayne, Inc., New York, N.Y.

[21] Appl. No.: 56,037

[22] Filed: Jul. 9, 1979

[51] Int. Cl.[3] ..... A44C 25/00

[52] U.S. Cl. ..... 63/2; 24/201 A; 24/223; 63/23

[58] Field of Search ..... 63/1 R, 2, 23; 24/201 A, 223, 230 BC; 59/93

[56] References Cited

U.S. PATENT DOCUMENTS

| | | | |
|---|---|---|---|
| 273,792 | 3/1883 | Adams | 59/93 X |
| 293,419 | 2/1884 | Church | 24/230 BC |
| 400,511 | 4/1889 | Tainter et al. | 24/223 X |
| 1,141,992 | 6/1915 | Toelcke | 63/1 R X |
| 1,265,778 | 5/1918 | Hartline | 59/93 UX |
| 1,494,610 | 5/1924 | McGlashan | 24/201 A X |
| 1,521,619 | 1/1925 | Haas | 24/201 A UX |
| 2,244,944 | 6/1941 | Furlonge | 63/2 |
| 3,983,716 | 10/1976 | Kuhn | 63/1 R |

FOREIGN PATENT DOCUMENTS

| | | | |
|---|---|---|---|
| 6709 | of 1908 | United Kingdom | 24/201 A |
| 752167 | of 1956 | United Kingdom | 63/2 |

*Primary Examiner*—F. Barry Shay

[57] ABSTRACT

A device for carrying a removable pendant from a chain or necklace which has an aperture into which is inserted the top bar of a T-shaped member which carries the pendant. Means are provided for closure of the aperture by a movable element having a protuberance extending through said aperture, locking the pendant within the device.

13 Claims, 8 Drawing Figures

FIG. 1
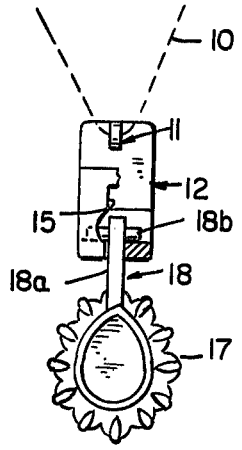
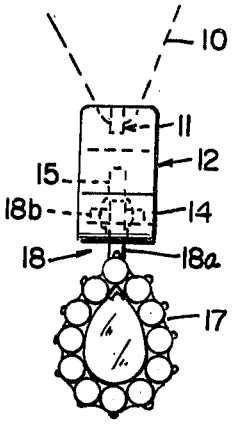
FIG. 2
FIG. 3
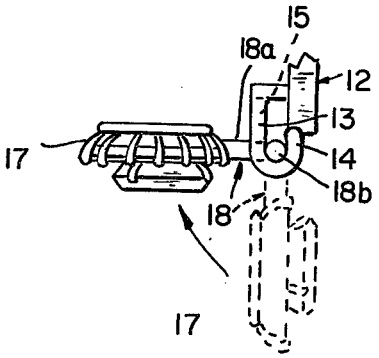
FIG. 4
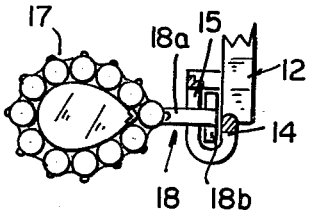
FIG. 5
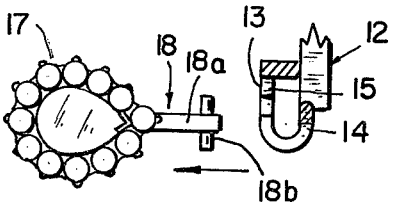
FIG. 6
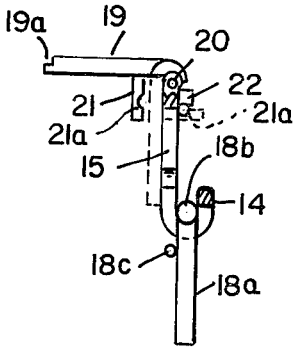
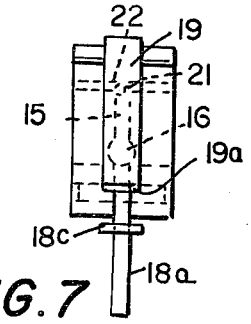
FIG. 7
FIG. 8
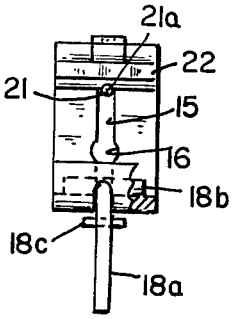

DEVICE FOR CARRYING A REMOVABLE PENDANT

Various buckles, fasteners and coupling devices are known in the art such as those described in U.S. Pat. Nos. 427,335, 1,037,045, 1,494,610, 1,792,128, 1,853,938, 2,030,563, 2,477,575 and 2,646,940. However, none of these devices enables one to place a pendant on a necklace or chain in a removable but highly secure manner.

SUMMARY OF THE INVENTION

According to the device of the present invention, a removable pendant may be carried from a chain or necklace in such a way as to enable the pendant to be easily removed or interchanged with other pendants. The device comprises a member which terminates in a curved portion and has an aperture from just below the top of the member to just beyond the point of curvature. The aperture has an enlargement at approximately the mid-point thereof for the purpose of receiving the pendant which is secured to a T-shaped member. The T-shaped member is inserted through the enlargement and the pendant is then rotated 90° whereby the pendant is locked in a secure but removable position.

The instant invention may be readily understood with reference to the drawings wherein:

FIG. 1 is a rear elevation showing said device being carried by a chain or necklace;

FIG. 2 is a front elevation;

FIG. 3 is a side elevation;

FIG. 4 is a side elevation showing the pendant positioned for removal;

FIG. 5 is a side view similar to FIG. 4 showing the pendant removed;

FIG. 6 is a side elevation of a further embodiment;

FIG. 7 is a front elevation of the embodiment of FIG. 6 with a pendant (not shown) locked in place; and FIG. 8 is a rear elevation partially broken away.

The present invention may be more clearly appreciated by reference to the aforesaid figures. A chain or necklace 10 may have placed thereon a bail or similar structure 11 which may be suitably decorated to which is secured the device 12 of the present invention, or device 12 may be attached directly to the clain or necklace. The device 12 comprises a member 13 of any convenient configuration terminating in a curved portion 14. The configuration illustrated is that of a "J". An aperture 15 which may, for example, be in the configuration of a reverse key-hole slot begins just below the top of 12 and extends just beyond the curvature of 14 (see FIG. 6). Said aperture 15 has an enlargement 16 which enables a pendant to be removably placed in said device 12. The pendant itself 17 is secured to a T-shaped member 18 comprising a leg **18*a* and a top 18*b*. Said member 18 may also have bar 18*c* of overall length shorter than the top of the T 18*b*. In operation the pendant 17 which is securely attached to said T-shaped member 18 is inserted into aperture 15 by rotating it to the position shown in FIG. 5, inserting the top of the T 18*b* through the aperture 15 and leg 18*a* through the enlargement 16, rotating the pendant 90° and pulling it thereafter downward to the position shown in FIGS. 1, 2, 6, 7 and 8. As can be seen from FIGS. 1 and 3, leg 18 has a rectangular cross section. As can be seen from FIGS. 1, 2 and 8, aperture 15 is substantially the same size as leg 18 so that it would not be possible to rotate leg 18 90° in said aperture unless it were rotated in enlargement 16 of aperture 15. If the T-shaped member has bar 18*c* (which forms a preferred embodiment of the present invention), the pendant is FIGS. 6–8 disclose a preferred embodiment wherein device 12 has an aperature closure element 19 movably secured to member 13, such as by hinge 20. T-shaped member 18 preferably has a bar 18*c*. The distance between bar 18*c* and pendant 17 may be minimal as long as it is sufficient to allow the pendant (not shown), attached to leg 18, to be attached and removed from device 12. Element 19 preferably has a concave portion 19*a* which acts as a stop to bar 18*c* when element 19 is moved so as to close aperture 15. Device 19 preferably has a protuberance 21 which passes through the aperture as shown so that surface 21*a* seats firmly against the bottom of 22 and extends out therefrom. To remove member 18, the operation is simply reversed so that element 19 is moved away from aperture 15**.

The device of the present invention not only provides a secure means of attaching a pendant to a necklace or chain, but has the added advantages of permitting the necklace to be worn without the pendant, to be worn with a variety of different pendants and permits the pendant to be worn separately such as on a different chain or necklace having the device of the present invention.

I claim:

1. A device for carrying a removable pendant from a chain or necklace which comprises a member terminating in a curved portion and having an aperture extending from just below the top of said member to just beyond the point of curvature, said aperture having an enlargement at approximately the mid-point thereof and an aperture closure element attached to said member adapted to move from a position wherein said aperture is open to a position wherein that portion of said aperture from just below the top of said member to slightly below said enlargement is closed on one side, said element having a protuberance extending substantially at a right angle therefrom and positioned so that when said element is in the closed position, said protuberance extends through said aperture and seats against a surface of said member beyond said aperture.

2. A chain or necklace having secured thereto the device of claim 1 and having a pendant affixed to a T-shaped pendant carrying or supporting member.

3. A device according to claim 1 wherein said aperture closure element is hinged to said member.

4. A combination comprising the device of claim 4 and a T-shaped pendant carrying or supporting member.

5. A chain or necklace having secured thereto the device of claim 4 and having a pendant affixed to a T-shaped pendant carrying or supporting member.

6. A device according to claim 1, wherein said member has a J-configuration.

7. A combination comprising the device of claim 5 and a T-shaped pendant carrying or supporting member.

8. A device according to claim 6 wherein the end of said aperture closure element is concave and said T-shaped member has a bar extending transverse to the leg of the T which bar is of overall length shorter than the top of the T and is positioned to meet with said concave end, whereby the bar and concave end limit the movement of said T-shaped member.

9. A chain or necklace having secured thereto the device of claim 6, and having a pendant affixed to a T-shaped pendant carrying or supporting member.

10. A chain or necklace according to claim 9 wherein the end of said aperture closure element is concave and said T-shaped member has a bar extending transverse to the leg of the T which bar is of overall length shorter than the top of the T and is positioned to meet with said concave end, whereby said bar and concave end limit the movement of said T-shaped member.

11. A combination comprising the device of claim 1 and a T-shaped pendant carrying or supporting member.

12. A combination according to claim 6, wherein said T-shaped member has a bar extending transverse to the leg of the T which bar is of overall length shorter than the top of the T.

13. A chain or necklace according to claim 11 wherein said T-shaped member has a bar extending transverse to the leg of the T which bar is of overall length shorter than the top of the T.

* * * * *